US007756251B2

(12) United States Patent
Davis et al.

(10) Patent No.: US 7,756,251 B2
(45) Date of Patent: Jul. 13, 2010

(54) X-RAY RADIATION WINDOW WITH CARBON NANOTUBE FRAME

(75) Inventors: Robert C. Davis, Provo, UT (US); Richard R. Vanfleet, Provo, UT (US); David N. Hutchison, Ithaca, NY (US)

(73) Assignee: Brigham Young Univers ity, Provo, UT (US)

( * ) Notice: Subject to any disclaimer, the term of this patent is extended or adjusted under 35 U.S.C. 154(b) by 0 days.

(21) Appl. No.: 12/239,339

(22) Filed: Sep. 26, 2008

(65) Prior Publication Data

US 2009/0086923 A1 Apr. 2, 2009

Related U.S. Application Data

(60) Provisional application No. 60/995,881, filed on Sep. 28, 2007.

(51) Int. Cl.
*G21K 1/00* (2006.01)

(52) U.S. Cl. ..... 378/161; 378/210

(58) Field of Classification Search ..... 378/145, 378/161; 977/701, 720–723, 742, 753, 778, 977/781, 784, 785, 902, 904, 931, 963, 842, 977/943, 946

See application file for complete search history.

(56) References Cited

U.S. PATENT DOCUMENTS

| | | | |
|---|---|---|---|
| 1,946,288 | A | 2/1934 | Kearsley |
| 2,291,948 | A | 8/1942 | Cassen |
| 2,316,214 | A | 4/1943 | Atlee et al. |
| 2,329,318 | A | 9/1943 | Atlee et al. |
| 2,683,223 | A | 7/1954 | Hosemann |
| 2,952,790 | A | 9/1960 | Steen |
| 3,679,927 | A | 7/1972 | Kirkendall |
| 3,828,190 | A | 8/1974 | Dahlin et al. |
| 4,160,311 | A | 7/1979 | Ronde et al. |
| 4,178,509 | A | 12/1979 | More et al. |
| 4,184,097 | A | 1/1980 | Auge |
| 4,393,127 | A | 7/1983 | Greschner et al. |
| 4,463,338 | A | 7/1984 | Utner et al. |

(Continued)

FOREIGN PATENT DOCUMENTS

| | | |
|---|---|---|
| DE | 1030936 | 5/1958 |

(Continued)

OTHER PUBLICATIONS

Hutchison, "Vertically aligned carbon nanotubes as a framework for microfabrication of high aspect ration mems," 2008, pp. 1-50.

(Continued)

*Primary Examiner*—Edward J Glick
*Assistant Examiner*—Anastasia Midkiff
(74) *Attorney, Agent, or Firm*—Thorpe North & Western, LLP

(57) ABSTRACT

An x-ray transmissive window comprises a plurality of carbon nanotubes arranged into a patterned frame. At least one transmission passage is defined in the patterned frame, the transmission passage extending from a base of the patterned frame to a face of the patterned frame. A film is carried by the patterned frame, the film at least partially covering the transmission passage while allowing transmission of x-rays through the transmission passage.

20 Claims, 5 Drawing Sheets

U.S. PATENT DOCUMENTS

| | | | |
|---|---|---|---|
| 4,521,902 | A | 6/1985 | Peugeot |
| 4,591,756 | A | 5/1986 | Avnery |
| 4,679,219 | A | 7/1987 | Ozaki |
| 4,777,642 | A | 10/1988 | Ono |
| 4,797,907 | A | 1/1989 | Anderton |
| 4,819,260 | A | 4/1989 | Haberrecker |
| 4,933,557 | A | 6/1990 | Perkins |
| 4,939,763 | A | 7/1990 | Pinneo et al. |
| 4,979,198 | A | 12/1990 | Malcolm et al. |
| 5,010,562 | A | 4/1991 | Hernandez et al. |
| 5,066,300 | A | 11/1991 | Isaacson et al. |
| 5,077,771 | A | 12/1991 | Skillicorn et al. |
| 5,077,777 | A | 12/1991 | Daly |
| 5,105,456 | A | 4/1992 | Rand et al. |
| 5,117,829 | A | 6/1992 | Miller et al. |
| 5,153,900 | A | 10/1992 | Nomikos et al. |
| 5,161,179 | A | 11/1992 | Suzuki et al. |
| 5,173,612 | A | 12/1992 | Imai et al. |
| 5,226,067 | A | 7/1993 | Allred et al. |
| RE34,421 | E | 10/1993 | Parker et al. |
| 5,267,294 | A | 11/1993 | Kuroda et al. |
| 5,391,958 | A | 2/1995 | Kelly |
| 5,400,385 | A | 3/1995 | Blake et al. |
| 5,428,658 | A | 6/1995 | Oettinger et al. |
| 5,432,003 | A | 7/1995 | Plano et al. |
| 5,469,429 | A | 11/1995 | Yamazaki et al. |
| 5,469,490 | A | 11/1995 | Golden et al. |
| 5,478,266 | A | 12/1995 | Kelly |
| RE35,383 | E | 11/1996 | Miller et al. |
| 5,607,723 | A | 3/1997 | Plano et al. |
| 5,621,780 | A | 4/1997 | Smith et al. |
| 5,627,871 | A | 5/1997 | Wang |
| 5,631,943 | A | 5/1997 | Miles |
| 5,682,412 | A | 10/1997 | Skillicorn et al. |
| 5,696,808 | A | 12/1997 | Smith et al. |
| 5,729,583 | A | 3/1998 | Tang et al. |
| 5,812,632 | A | 9/1998 | Schardt et al. |
| 5,907,595 | A | 5/1999 | Sommerer |
| 6,005,918 | A | 12/1999 | Harris et al. |
| 6,044,130 | A | 3/2000 | Inazura et al. |
| 6,069,278 | A | 5/2000 | Chuang |
| 6,075,839 | A | 6/2000 | Treseder |
| 6,097,790 | A | 8/2000 | Gasegawa et al. |
| 6,133,401 | A | 10/2000 | Jensen |
| 6,134,300 | A | 10/2000 | Trebes et al. |
| 6,184,333 | B1 | 2/2001 | Gray |
| 6,205,200 | B1 | 3/2001 | Boyer et al. |
| 6,277,318 | B1 | 8/2001 | Bower |
| 6,282,263 | B1 | 8/2001 | Arndt et al. |
| 6,288,209 | B1 | 9/2001 | Jensen |
| 6,307,008 | B1 | 10/2001 | Lee et al. |
| 6,320,019 | B1 | 11/2001 | Lee et al. |
| 6,351,520 | B1 | 2/2002 | Inazaru |
| 6,477,235 | B2 | 11/2002 | Chornenky et al. |
| 6,487,272 | B1 | 11/2002 | Kutsuzawa |
| 6,487,273 | B1 | 11/2002 | Takenaka et al. |
| 6,546,077 | B2 | 4/2003 | Chornenky et al. |
| 6,658,085 | B2 | 12/2003 | Sklebitz |
| 6,661,876 | B2 | 12/2003 | Turner et al. |
| 6,778,633 | B1 | 8/2004 | Loxley et al. |
| 6,816,573 | B2 | 11/2004 | Hirano et al. |
| 6,819,741 | B2 | 11/2004 | Chidester |
| 6,956,706 | B2 | 10/2005 | Brandon |
| 6,976,953 | B1 | 12/2005 | Pelc |
| 6,987,835 | B2 | 1/2006 | Lovoi |
| 7,035,379 | B2 | 4/2006 | Turner et al. |
| 7,046,767 | B2 | 5/2006 | Okada et al. |
| 7,085,354 | B2 | 8/2006 | Kanagami |
| 7,108,841 | B2 | 9/2006 | Smalley |
| 7,130,380 | B2 | 10/2006 | Lovoi et al. |
| 7,130,381 | B2 | 10/2006 | Lovoi et al. |
| 7,224,769 | B2 | 5/2007 | Turner |
| 7,286,642 | B2 | 10/2007 | Ishikawa et al. |
| 7,382,862 | B2 | 6/2008 | Bard et al. |
| 7,428,298 | B2 | 9/2008 | Bard et al. |
| 2002/0075999 | A1 | 6/2002 | Rother |
| 2002/0094064 | A1 | 7/2002 | Zhou |
| 2005/0018817 | A1 | 1/2005 | Oettinger et al. |
| 2005/0141669 | A1 | 6/2005 | Shimono et al. |
| 2006/0073682 | A1 | 4/2006 | Furukawa et al. |
| 2006/0098778 | A1 | 5/2006 | Oettinger et al. |
| 2006/0233307 | A1 | 10/2006 | Dinsmore |
| 2006/0269048 | A1 | 11/2006 | Cain |
| 2007/0133921 | A1* | 6/2007 | Haffner et al. ..... 385/12 |
| 2007/0183576 | A1 | 8/2007 | Burke et al. |

FOREIGN PATENT DOCUMENTS

| | | |
|---|---|---|
| DE | 4430623 | 3/1996 |
| DE | 19818057 | 11/1999 |
| EP | 0297808 | 1/1989 |
| EP | 0330456 | 8/1989 |
| GB | 1252290 | 11/1971 |
| JP | 57082954 | 8/1982 |
| JP | 05066300 | 3/1993 |
| JP | 06119893 | 7/1994 |
| JP | 2003-510236 | 3/2003 |
| JP | 2006-297549 | 11/2006 |
| KR | 10-2005-0107094 | 11/2005 |

OTHER PUBLICATIONS

Ma, R. Z., et al., "Processing and properties of carbon nanotubes-nano-SiC ceramic," Journal of Materials Science 1998, pp. 5243-5246, vol. 33.

Chen, Xiaohua et al., "Carbon-nanotube metal-matrix composites prepared by eletroless plating," Composites Science and Technology, 2000, pp. 301-306, vol. 60.

Flahaut, E. et al., "Carbon Nanotube-metal-oxide nanocomposites: microstructure, electrical conductivity and mechanical properties," Acta mater., 2000, pp. 3803-3812, vol. 48.

Peigney, et al., "Carbon nanotubes in novel ceramic matrix nanocomposites," Ceramics International, 2000, pp. 677-683, vol. 26.

Satishkumar B.C., et al., "Synthesis of metal oxide nanorods using carbon nanotubes as templates," Journal of Materials Chemistry, 2000, pp. 2115-2119, vol. 10.

Li, Jun et al., "Bottom-up approach for carbon nanotube interconnects," Applied Physics Letters, Apr. 14, 2003, pp. 2491-2493, vol. 82 No. 15.

Jiang, Linqin et al., "Carbon nanotubes-metal nitride composites: a new class of nanocomposites with enhanced electrical properties," J. Mater.Chem., 2005, pp. 260-266, vol. 15.

Yan, Xing-Bin, et al., Fabrications of Three-Dimensional ZnO-Carbon Nanotube (CNT) Hybrids Using Self-Assembled CNT Micropatterns as Framework, 2007, pp. 17254-17259, vol. 111.

Davis, Robert C., et al., U.S. Appl. No. 12/239,281, filed Sep. 26, 2008.

Davis, Robert C., U.S. Appl. No. 12/239,302, filed Sep. 26, 2008.

http://www.orau.org/ptp/collectio/xraytubescollidge/MachlettCW250T.htm, 1999, 2 pages.

Micro X-ray Tubem Operation Manual, X-ray and Specialty Instruments Inc., 1996, 5 pages.

Sheather, "The support of thin windows for x-ray proportional countrers," Journal Phys. E., Apr. 1973, pp. 319-322, vol. 6, No. 4.

* cited by examiner

X-RAY RADIATION WINDOW WITH CARBON NANOTUBE FRAME

PRIORITY

Priority is claimed of U.S. Provisional Patent Application Ser. No. 60/995,881, filed Sep. 28, 2007, which is hereby incorporated herein by reference.

RELATED APPLICATIONS

This application is related to U.S. patent application Ser. No. 12/239,281, filed Sep. 26, 2008, entitled Carbon Nanotube Assembly; and is related to U.S. patent application Ser. No. 12/239,302, filed Sep. 26, 2008, entitled Carbon Nanotube MEMS Assembly.

BACKGROUND

Radiation detection systems can be used in connection with electron microscopy, X-ray telescopy, and X-ray spectroscopy. Radiation detection systems typically include a radiation detection window, which can pass radiation emitted from the radiation source to a radiation detector or sensor, and can also filter or block undesired radiation.

Standard radiation detection windows typically comprise a sheet of material, which is placed over an opening or entrance to the detector. As a general rule, the thickness of the sheet of material corresponds directly to the ability of the material to pass radiation. Accordingly, it is desirable to provide a sheet of material that is as thin as possible, yet capable of withstanding pressure resulting from gravity, normal wear and tear, and pressure differentials.

Since it is desirable to minimize thickness in the sheets of material through which radiation is passed, it is often necessary to support the thin sheet of material with a support structure to enable the material to withstand pressure forces. Known support structures include frames, screens, meshes, ribs, and grids. While useful for providing support to an often thin and fragile sheet of material, many support structures, particularly those comprising silicon, are known to interfere with the passage of light through the sheet of material due to the structure's geometry, thickness and/or composition.

SUMMARY OF THE INVENTION

In accordance with one embodiment, the invention provides an x-ray transmissive window, including a plurality of carbon nanotubes arranged into a patterned frame, and at least one transmission passage defined in the patterned frame. The transmission passage can extend from a base of the patterned frame to a face of the patterned frame. A film can be carried by the patterned frame, the film at least partially covering the transmission passage while allowing transmission of x-rays through the transmission passage.

In accordance with another aspect of the invention, an x-ray transmissive window is provided, including a plurality of carbon nanotubes arranged into a patterned frame, and an interstitial material at least partially filling interstices between at least some of the carbon nanotubes. At least one transmission passage can be defined through the patterned frame. A film can be carried by the patterned frame, the film being operable to allow transmission of x-rays through the transmission passage.

In accordance with another aspect of the invention, a radiation detection system is provided, including an enclosure and a sensor, contained within the enclosure. The sensor can be operable to detect x-rays entering the enclosure. An x-ray transmissive window can be attached to the enclosure, the window being formed of a plurality of carbon nanotubes arranged into a patterned frame, the patterned frame including at least one transmission passage defined therethrough. A film can be carried by the patterned frame, the film at least partially covering the transmission passage while allowing transmission of x-rays through the transmission passage.

In accordance with another aspect of the invention, a method of forming an x-ray transmissive window is provided, including: applying a catalyst to a substrate to create a defined pattern on the substrate; growing a plurality of carbon nanotubes from the catalyst applied in the pattern to form a patterned frame of carbon nanotubes having at least one transmission passage defined therethrough; applying an interstitial material to the carbon nanotubes to at least partially fill interstices between at least some of the carbon nanotubes; and forming a film on, or attaching a film to, a face of the patterned frame, the film being operable to allow transmission of x-rays through the at least one transmission passage.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Figure 1:
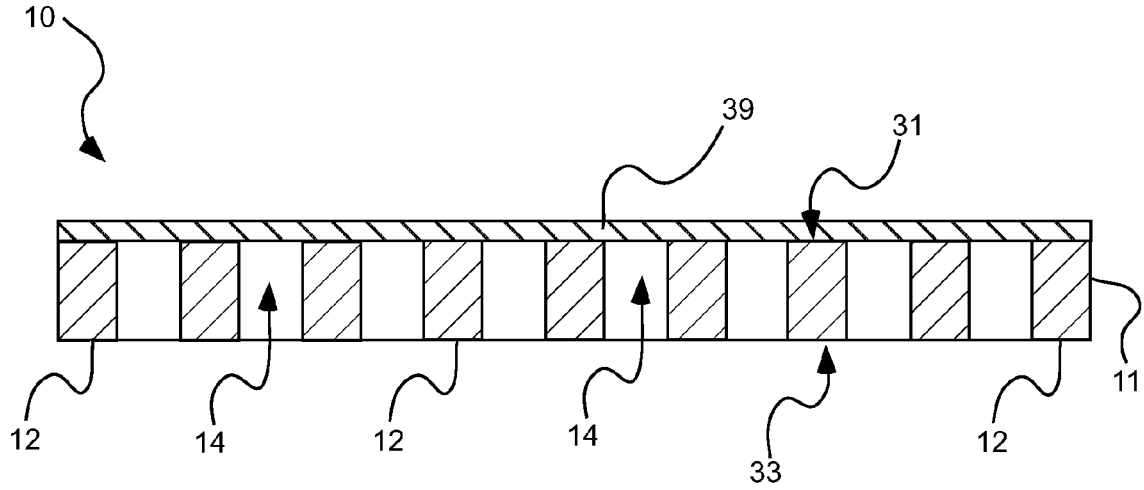
FIG. 1 is a side, sectional, schematic view of an x-ray transmissive window in accordance with an embodiment of the invention.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENTS

The following detailed description of exemplary embodiments of the invention makes reference to the accompanying drawings, which form a part hereof and in which are shown, by way of illustration, exemplary embodiments in which the invention may be practiced. While these exemplary embodiments are described in sufficient detail to enable those skilled in the art to practice the invention, it should be understood that other embodiments may be realized and that various changes to the invention may be made without departing from the spirit and scope of the present invention.

In describing and claiming the present invention, the following terminology will be used.

As used here, the term "vertically grown" is used to describe nanotubes that are generally grown upward from a substrate or catalyst material. While such nanotubes exhibit a generally vertical attitude, it is to be understood that such tubes are not necessarily perfectly straight or perfectly upright, but will tend to grow, twist or otherwise meander laterally to some degree, as would be appreciated by one of ordinary skill in the art.

As used herein, relative terms, such as "upper," "lower," "upwardly," "downwardly," "vertically," etc., are used to refer to various components, and orientations of components, of the systems discussed herein, and related structures with which the present systems can be utilized, as those terms would be readily understood by one of ordinary skill in the relevant art. It is to be understood that such terms are not intended to limit the present invention but are used to aid in describing the components of the present systems, and related structures generally, in the most straightforward manner. For example, one skilled in the relevant art would readily appreciate that a "vertically grown" carbon nanotube turned on its side would still constitute a vertically grown nanotube, despite its lateral orientation.

As used herein, the term "interstitial" material is used to refer to a material that at least partially fills interstices, or small spaces, between or in individual nanotubes that form an array of nanotubes.

As used herein, the term "patterned frame" is to be understood to refer to a framework or latticework or grate that includes an often planar base and an often planar face with constituent materials of the patterned frame arranged laterally relative to, and generally beginning or terminating at, the base and the face of the patterned frame. In most cases, the patterned frame will include one or more laterally extending walls that define, circumscribe or surround one or more passages extending through the frame from the base of the frame to the face of the frame. A grate structure having a repeating pattern formed by a plurality of intersecting walls that define a plurality of equally shaped and spaced passages is one non-limiting example of a patterned frame used in accordance with the present invention.

As used herein, the term "passage" refers to an opening or a void formed in a patterned frame by the carbon nanotubes that define or constitute the frame. A passage can be completely devoid of material, or it can be filled, or partially filled, with an interstitial material used to fill interstices between and/or in the carbon nanotubes.

As used herein, the term "interlocked" is to be understood to refer to a relationship between two or more carbon nanotubes in which the nanotubes are held together, to at least some degree, by forces other than those applied by an interstitial coating or filling material. Interlocked nanotubes may be intertwined with one another (e.g., wrapped about one another), or they may be held together by surface friction forces, van der Waals forces, and the like.

When nanotubes are discussed herein as being "linearly arranged" or "extending linearly," it is to be understood that the nanotubes, while possibly being slightly twisted, curved, or otherwise meandering laterally, are generally arranged or grown so as to extend lengthwise. Such an arrangement is to be distinguished from nanotubes that are randomly dispersed throughout a medium.

As used herein, the term "substantially" refers to the complete or nearly complete extent or degree of an action, characteristic, property, state, structure, item, or result. As an arbitrary example, when an object or group of objects is/are referred to as being "substantially" symmetrical, it is to be understood that the object or objects are either completely symmetrical or are nearly completely symmetrical. The exact allowable degree of deviation from absolute completeness may in some cases depend on the specific context. However, generally speaking the nearness of completion will be so as to have the same overall result as if absolute and total completion were obtained.

The use of "substantially" is equally applicable when used in a negative connotation to refer to the complete or near complete lack of an action, characteristic, property, state, structure, item, or result. As an arbitrary example, an opening that is "substantially free of" material would either completely lack material, or so nearly completely lack material that the effect would be the same as if it completely lacked material. In other words, an opening that is "substantially free of" material may still actually contain some such material as long as there is no measurable effect as a result thereof.

INVENTION

Figure 3:
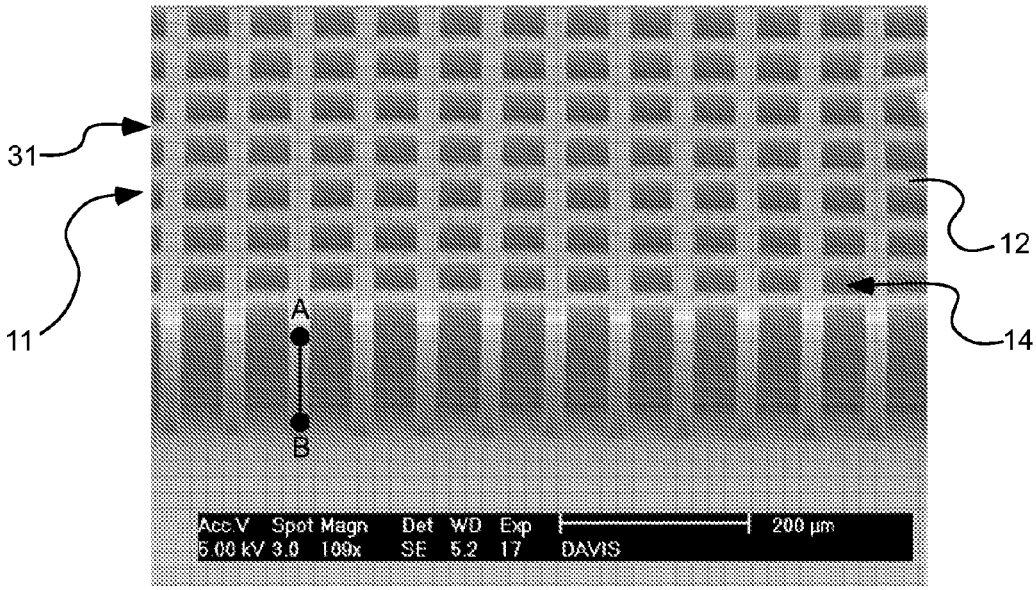
FIG. 3 is an SEM image of a high-density carbon nanotube patterned frame in accordance with an embodiment of the invention.
Figure 4:
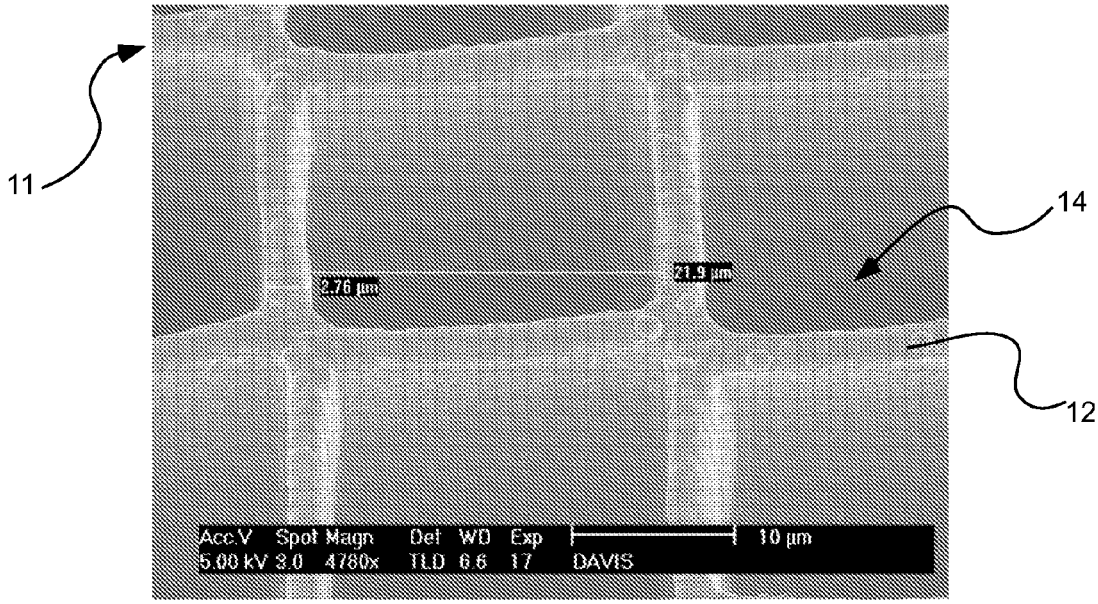
FIG. 4 is a more detailed SEM image of the high-density carbon nanotube patterned frame of FIG. 3.

The present invention provides high strength windows for radiation detection system, and associated radiation detection systems. In accordance with one embodiment, shown by example in FIGS. 1 and 2, the invention provides an x-ray transmissive window 10 formed from a plurality of carbon nanotubes ("CNTs"—shown schematically at 21 in FIG. 5) arranged into a patterned frame 11 (best appreciated from FIG. 3). The frame typically includes at least one transmission passage 14 defined or formed therein that extends from a base 33 of the patterned frame to a face 31 of the patterned frame. An interstitial material typically covers, coats and/or fills the nanotubes, and generally fills interstices formed between adjacent CNTs. The interstitial material can be useful in binding the CNT "forest" or array into a solidified frame, as shown for example in FIGS. 2 and 4. A film 39 can be carried by the patterned frame. The film at least partially covers the transmission passage while allowing transmission of x-rays through the transmission passage.

Figure 2:
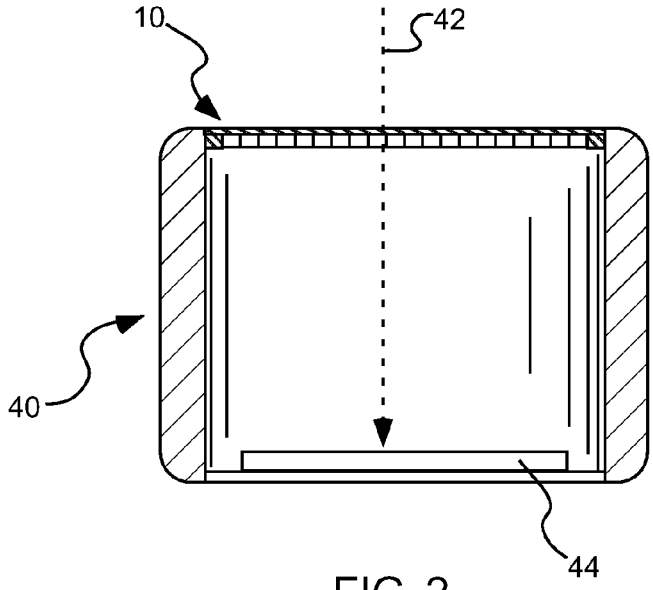
FIG. 2 is a sectional, schematic view of a radiation detection system in accordance with an embodiment of the invention.

The window 10 is advantageously configured for use in connection with a variety of radiation detection systems, one example of which is shown at 40 in FIG. 2. In many embodiments, the patterned frame 11 extends across the entire window opening of the detection system and provides passages arranged across the window opening. The window and associated radiation detection system can be useful for a variety of applications including those associated with electron microscopy, X-ray telescopy, and X-ray spectroscopy. In use, radiation in the form of high energy electrons and high energy photons (schematically indicated at 42 in FIG. 2) can be directed toward the window of the radiation detection system. The window receives and passes radiation therethrough. Radiation that is passed through the window reaches a sensor 44 (FIG. 2), which is operable to generate a signal based on the type and/or amount of radiation it receives, as would be appreciated by one of ordinary skill in the art having possession of this disclosure. The sensor 44 can be operatively coupled to various signal processing electronics (not shown).

The window 10 can be subject to, and performs admirably in, a variety of operating and environmental conditions, including for example, reduced or elevated pressures (including vacuum), contamination, etc. Such conditions tend to dictate thicker, more robust windows. However, useful radiation detection systems can be called upon to sense or detect limited or weak sources, where thick windows may not perform well. In addition, certain applications require or demand very precise measurements, conditions for which thicker windows may not perform well.

Conventional solutions to this problem have included providing support ribs that span the window to provide support to thinner window materials. Such supports, however, can introduce stress concentrations in the window material, can include a different thermal conductivity than the window material (and thereby introduce thermal stresses), and can interfere with the radiation transmission and detection directly. Other times, the material of supports can irradiate and introduce noise or errors into the detection process.

The x-ray windows of the present invention can provide a great deal of flexibility in designing both the geometric properties of the patterned frame (e.g., the size, spacing and shape of the passages formed in the frame), and the materials utilized to form the frame. As discussed in more detail below, an interstitial material is generally utilized to coat and/or fill and bind the nanotubes used to form the frame, and the interstitial material can be chosen to provide optimal performance in an x-ray window application.

As shown in various degrees of detail in FIGS. 1-4, the patterned frame 10 can include a plurality of walls or ribs 12 that define a plurality of passages 14 that extend from a base 33 of the patterned frame to a face 31 of the patterned frame. In the example shown in the figures, the passages include a generally square or rectangular shape. However, it is to be understood that the shape of the passages can be easily altered during the manufacturing process (as described in greater detail below) to provide passages of a variety shapes, include "diamond" shapes, oval shapes, circular shapes, trapezoids, etc.

The walls 12 serve to support the film 39 as the walls terminate in generally planar face 31. Generally, the walls will share a common height, but can be grown (by methods discussed in greater detail below) to varying heights, if a particular application so dictates. In one aspect, the walls are sufficiently thin to allow some radiation to pass directly through the material of the walls.

Regardless of the shape of the passages 14, it is generally desirable that the passages occupy more area within the patterned frame 11 than do the plurality of walls 12. This is due to the fact that radiation will more freely pass through the passages than through the walls. In one aspect, the passages consume between about 75% to about 90% of the total area of the window. For example, in one embodiment the passages comprise at least about 75% of the total area of the window and the plurality of walls comprise no more than about 25% of the total area of the window. Alternatively, the passages can comprise at least about 90% of the total area of the window, and the plurality of walls can comprise no more than about 10% of the total area of the window.

The present invention allows a width of the walls 12 to be made advantageously very thin. The reduced thickness of the walls can relax the degree of collimation that is typically required for passing radiation such as X-rays through the ribs. Some conventional radiation windows require the use of a separate collimator prior to the introduction of radiation rays into a radiation window. The separate collimator is used to filter the rays and only allows rays that are substantially perpendicular to the surface of the radiation window to pass therethrough. However, collimators can be disadvantageous in that they can reduce the intensity of the signal received by the radiation detector since the collimator blocks and absorbs some radiation rays. Specifically, non-perpendicular rays are absorbed by the material of the collimator, and thus never reach the detector behind the radiation window.

Thinner walls created by the present invention can reduce the requirement or need for a separate collimator. In addition, as discussed in more detail below, some embodiments of the invention create the patterned frames from materials that are all or mostly carbon-based materials. Such materials allow some non-perpendicular radiation rays to pass through the thin walls. Thus, less radiation is absorbed by the collimator and more radiation is allowed to pass therethrough, resulting in a more accurate signal generated by the sensor. The result is that even with the same open area percentage, the transmission of radiation rays with higher energy from radiation windows having carbon-based material frames can be higher than that from windows formed of other materials.

The patterned frames 11 of the present invention are generally formed from a framework of carbon nanotubes ("CNTs"). In the exemplary patterned frame 11 shown in the SEM image of FIGS. 3 and 4, the frame includes a series of walls 12 with a series of passages (e.g., openings or cavities) 14 defined therebetween. The walls 12 can extend in divergent directions, forming right angles relative to one another, or a variety of other angles (e.g., 30 degrees, 45 degrees, etc.), depending upon the desired pattern of the frame. The line A-B in FIG. 3 indicates the generally upright, vertical, or linear orientation of the CNTs that form or define the walls of the patterned frame (note that, due to the very small scale of the CNTs, individual CNTs are not visible in the SEM image of FIGS. 3 and 4). The tubes in a typical assembly generally grow vertically up from a substrate, in a direction that is generally parallel to the line A-B. It can be seen from this indicative line that the regions where the CNTs grow form or define the walls of the patterned frame. A series of CNTs are illustrated schematically at 21 in FIG. 5.

As will be discussed in further detail below, the pattern, shape and geometry of the patterned frame can be relatively easily manipulated during the CNT growth process, providing a great deal of flexibility in designing patterned frames for a variety of x-ray windows. In the embodiment illustrated in FIGS. 1, 3 and 4, the patterned frame includes a series of walls that extend at right angles to one another to form a series of square passages.

The CNTs utilized in the patterned frame 11 of the window 10 can take a variety of forms. The CNTs can include single-wall CNTs or multi-wall CNTs. One particular advantage of the present invention lies in the ability to form high density arrays of CNTs with high aspect ratios. Patterned frames with high and narrow walls can be precisely formed into a variety of desired frame configurations. In one aspect, the CNTs utilized can include heights on the order of 10 μm and greater. While not so required, the CNTs can include diameters as small as 20 nm or less. The CNTs can be grown or fabricated in a variety of manners, many of which will be familiar to those of ordinary skill in the art. An exemplary grouping of CNTs is illustrated schematically at 21 in FIG. 5. In this illustration, the generally linear arrangement of the CNTs from a base 33 of the frame 11 (or wall 12) to a face 31 of the frame can be appreciated.

While not so required, many of the patterned frames of the windows formed in accordance with the present invention will include a generally planar face and a generally planar base, with the CNTs of the frame extending from the face to the base. For example, FIG. 1 illustrates one exemplary patterned frame 11, with the face 31 of the frame being defined by upper portions of the CNT walls 12, which collectively form a grid surface. While the faces and bases of the various examples shown in the figures are generally planar, it is to be understood that the faces and/or the bases may include a curvature.

In one specific example of the invention, CNTs can be grown by first preparing a sample by applying 30 nm of alumina on an upper surface of a supporting silicon wafer. A patterned, 3-4 nm Fe film can be applied to the upper surface of the alumina. The resulting sample can be placed on a quartz "boat" in a one inch quartz tube furnace and heated from room temperature to about 750 degrees C. while flowing 500 sccm of $H_2$. When the furnace reaches 750 degrees C. (after about 8 minutes), a $C_2H_4$ flow can be initiated at 700 sccm (if slower growth is desired, the gases may be diluted with argon). After a desired CNT length (or height) is obtained, the $H_2$ and $C_2H_4$ gases can be removed, and Ar can be initiated at 350 sccm while cooling the furnace to about 200 degrees C. in about 5 minutes.

The above example generated multi-walled CNTs with an average diameter of about 8.5 nm and a density of about 9.0 kg/m. It was also found that the conditions above produced a CNT "forest" of high density, interlocked or intertwined CNTs that can be grown very tall while maintaining very narrow features in the patterned frame.

The intertwining of the CNT during growth is advantageous in that the CNTs maintain a lateral pattern (generally defined by a catalyst from which the CNTs are grown) while growing vertically upward, as the CNTs maintain an attraction to one another during growth. Thus, rather than achieving random growth in myriad directions, the CNTs collectively maintain a common, generally vertical attitude while growing.

The interstitial material can be selected to provide the patterned frame of the window with a variety of desirable characteristics. Generally speaking, the interstitial material can be selected to provide advantages tailored to the intended use of the patterned frame. Examples of suitable filler or interstitial material can include, without limitation, Si, $Si_3N_4$, carbon and SiC, to name only a few suitable materials.

In one specific example, an assembly was formed by creating a forest of CNTs formed into a patterned frame (as outlined above). The frame was then filled and/or coated with an interstitial material by a low-pressure chemical vapor deposition ("LPCVD") process using undoped polycrystalline silicon. In this process, a LPCVD furnace was used at 200 mTorr and substrate temperature of 580 degrees C., flowing 20 sccm of $SiH_4$, for 2 hours and 50 minutes. This process resulted in a deposition rate on a planar surface (or a radial deposition rate on the carbon nanotubes) of about 1.8 nm/min. Upon completion, the LPCVD furnace was vented with $N_2$, and the sample was removed at a rate of about 1 cm/s.

In another specific example, the frame was filled and/or coated with an amorphous carbon interstitial material by an atmospheric CVD process. The filling or coating process was performed immediately after the growth of the CNT forest and prior to removal of the forest from the furnace. The temperature was raised to 900 degrees C. flowing Ar at 500 sccm. A one-hour carbon deposition with ethylene (25 sccm) and argon (225 sccm) followed by a 30 minute anneal at 1000 degrees C. (500 sccm of argon) substantially fills the CNT forest.

The present invention advantageously allows the selection of the interstitial material based upon an intended use, or desired attributes, of the resulting patterned frame. For example, in some applications, a greater or lesser degree of thermal or electrical conductivity may be desired. A greater or lesser degree of physical strength and/or weight may be desired. Resistance to various chemicals or environments can also be considerations that can affect selection of the interstitial material. The present invention can advantageously be adapted for a variety of materials to address these and other design goals.

Figure 5:
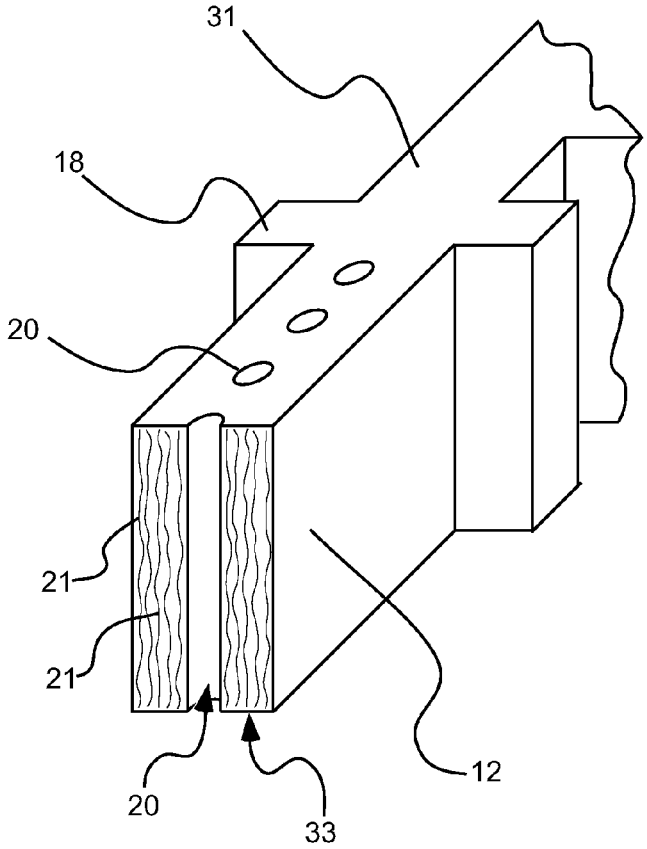
FIG. 5 is a partially sectioned view of a carbon nanotube frame in accordance with an aspect of the invention.

While the present invention provides patterned CNT frames for use in x-ray windows having high aspect ratios, the inventors have found that walls of patterned frames grown above certain heights can tend to "fold" over due to the large height-to-thickness ratio. To address this issue, reinforcing nubs, extensions, or protuberances can be formed in the walls of the patterned frame during growth of the frame. One exemplary protuberance 18 is illustrated in FIG. 5. The protuberance can provide rigidity to the wall to enable growth of taller and narrower wall features while avoiding unwanted "fold over" of the wall. The reinforcing protuberance can be particularly advantageous in forming walls that span a considerable distance across the x-ray window plane.

Figure 6:
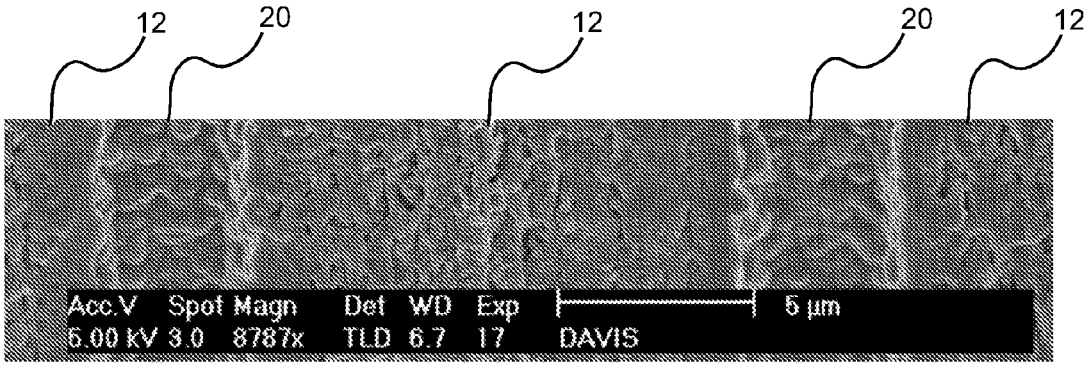
FIG. 6 is an SEM image of a portion of a cleaved carbon nanotube frame in accordance with an embodiment of the invention, illustrating a series of interstitial material access openings formed therein.

Also illustrated in FIGS. 5 and 6 are a series of interstitial material access holes 20 that can be utilized to enhance the filling/coating process of the present invention. The access holes 20 can be formed so as to extend substantially fully from the base 33 of the wall to the face 31 of the wall. The material access holes can be substantially devoid of nanotubes and can serve to increase penetration of the interstitial material into the forest of CNTs to ensure a fully (or more fully) impregnated forest. Thus, a finished patterned frame 10 for a window can include one or more passages (e.g., 14 in FIGS. 1 and 2) that are substantially devoid of any material, and interstitial material access holes 20 that are devoid of CNTs but that may be fully or partially filled during the manufacturing process by the interstitial material.

The interstitial material access holes 20 can be formed in a variety of manners. As will be discussed in further detail below, growth of the CNTs can be accomplished by applying a catalyst material to a substrate in a defined pattern. Where desired, voids can be created in the catalyst pattern as, or after, the catalyst is applied to the substrate. As the CNTs grow upwardly around these voids, the material access holes will be formed in the CNT forest. In one example, it was found that square access holes of about 3 μm in width, spaced 3 μm from one another, allowed a polysilicon interstitial material to fill the CNT forest to a depth about ten times greater than if the holes were not present. FIG. 6 includes an SEM image of a sectioned wall of a patterned frame showing two interstitial material access holes formed in the wall.

Generally speaking, the passages 14 are of larger diameter or opening size than are the interstitial material access holes 20, which are in turn of larger diameter or opening size than are the interstices between adjacent CNTs. While not so required, in one embodiment of the invention adjacent CNTs are spaced about 200-300 nm from one another, with the interstitial material access holes formed having a diameter or opening size of about 3 to about 20 um, and the larger passages formed with a diameter or opening size of 100 um or greater.

Figure 7:
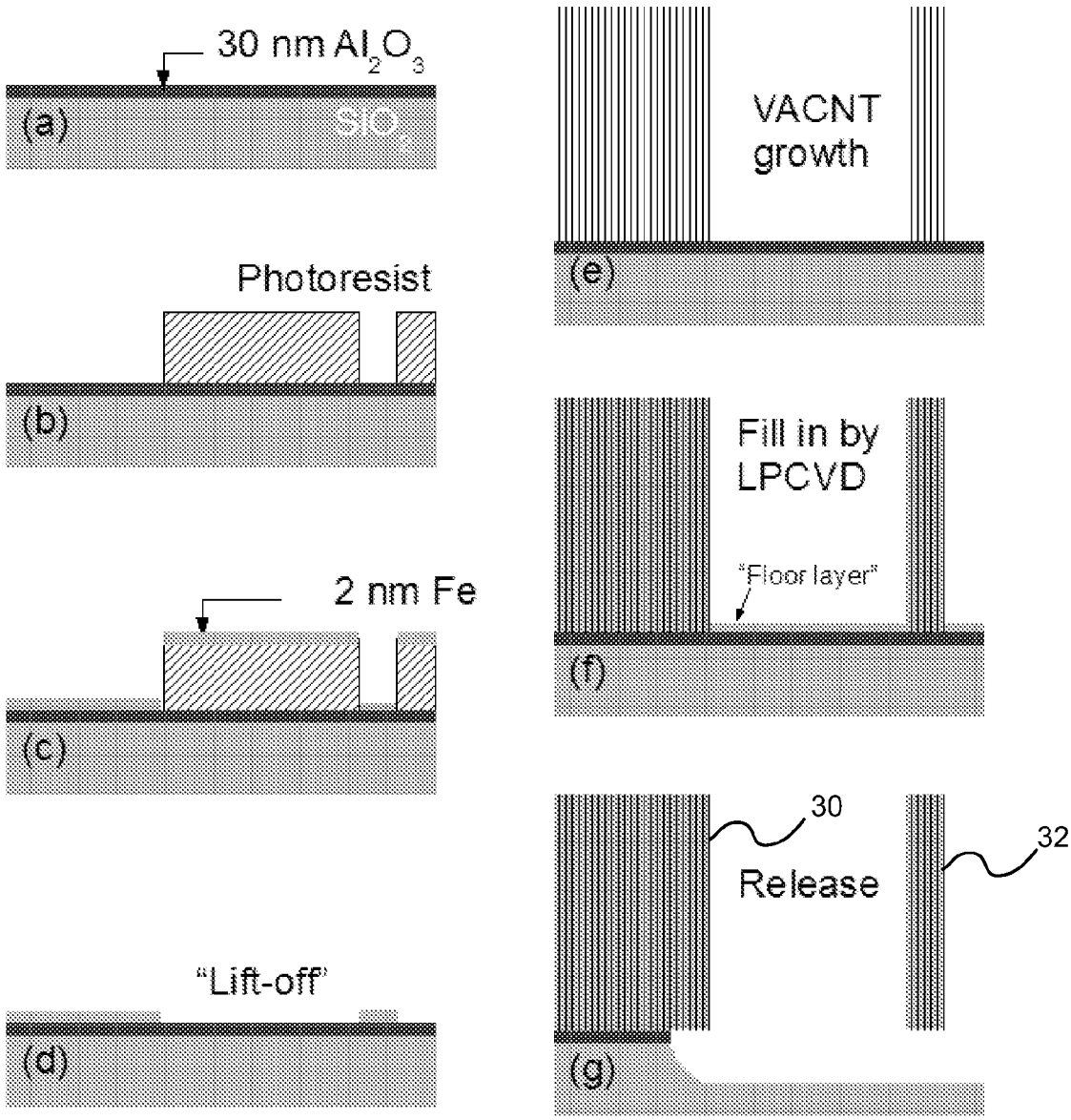
FIG. 7 illustrates a series of intervals of a fabrication process used in forming a carbon nanotube frame assembly in accordance with an aspect of the invention.

Formation of the patterned frames for x-ray windows can be accomplished in a variety of manners. FIG. 7 illustrates a series of processes exemplary of one manner of doing so. The process can begin at frame (a) of FIG. 7, where 30 nm of alumina is evaporated by electron beam evaporation onto a $SiO_2$ substrate. At (b), AZ330 photo resist is spun and patterned (note that the pattern is not evident from the view of FIG. 7—it would be apparent from a top view of the substrate). At (c), 7 nm of Fe is thermally evaporated on top of the photo resist. At (d), the photo resist is lifted off in a resist stripper. At (e), a forest of generally vertically-aligned CNTs is grown from the patterned iron film by chemical vapor deposition at 750 degrees C. using $C_2H_4$ and $H_2$ feedstock gases (note that, while the CNTs are shown schematically as generally straight and upright, there will likely be a considerable amount of intertwining or interlocking of the CNTs as they are grown). At (f), the CNT forest is coated (and/or infiltrated, bound together, etc., depending upon the materials utilized) with Si or other suitable materials by various chemical vapor deposition processes (e.g., low-pressure, atmospheric, high-pressure CVD, etc.).

While not specifically illustrated in FIG. 7, it will be appreciated by one of ordinary skill in the art having possession of this disclosure that infiltration step illustrated in frame (f) will often result a "floor layer" of interstitial or infiltration material being applied near the base of the patterned frame within the passages defined by the CNTs (e.g., at the bottom of "wells" or "cups" formed by the passages and the $Al_2O_3$). This floor layer can be removed in order to expose the underlying sacrificial layer for etching. The removal of the floor layer can be accomplished in a number of manners. In one aspect of the invention, a short reactive ion etch can be utilized. For example, a Reactive Ion Etch (RIE) can be accomplished at 100 W, 100 mTorr, flowing 3.1 sccm of $O_2$ and 25 sccm of $CF_4$, etching for 5-9 minutes (depending on the size of the features being etched). In another example, a $CH_3F/O_2$ Inductively Coupled Plasma RIE etch can be utilized. It is also contemplated that a wet etch can be utilized, for example by placing the sample in KOH or a similar solution to etch away the floor layer.

While each of these process may result etching or removing some of the interstitial material from the CNT forest, it has been found that the floor layer is removed before significant etching of the structure CNT structure occurs. Generally speaking, creation of the "floor layer," and subsequent removal of the floor layer, will be considerations in most of the processes utilized in coating or infiltrating the CNT patterned frame of the present invention.

At (g), the underlying $SiO_2$ is etched to release portions of the structure. This can be accomplished in a number of manners, including by immersion in HF. The resulting patterned frame will, in the example shown, include some portions that remain attached to the substrate (e.g., portion 30 of frame (g), while other portions (e.g., portion 32 of frame (g)) have been removed from the substrate. Depending upon the desired use of the patterned frame, all of the frame could be left attached to the substrate, only some of the frame can be removed from the substrate, or all of the frame can be removed from the substrate.

Removal of the frame from the substrate can be accomplished in a number of manners. In one embodiment, the frame can be simply pried off the substrate using mechanical force. Other embodiments can include the use of an etching process to remove the underlying sacrificial layer (e.g., $SiO_2$ in the example given above) or to attack the interface between layers to release the frame from the substrate. Once the frame is released (or prior to release, if more appropriate) the polymer film 39 can be applied to either the face or the base of the frame to complete the window.

In addition to the process steps outlined above, in some embodiments of the invention, a densification process can be implemented prior to applying the interstitial material to the CNTs arranged into the patterned frame for the x-ray window. For example, in one embodiment, the CNT "forest" can be exposed to ethanol vapor prior to being exposed to a Si interstitial material to densify the CNTs. This process was found to decrease feature size by as much as 10-100 times.

Figure 8A:
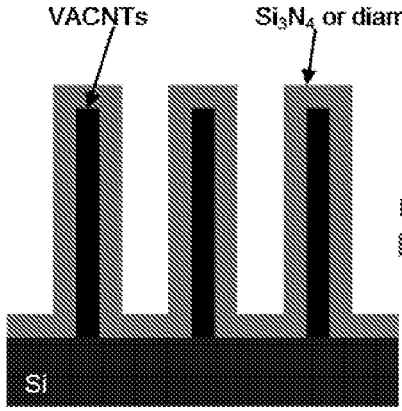
FIGS. 8A and 8B illustrate a series of intervals of another fabrication process used in forming a carbon nanotube x-ray transmissive window in accordance with an aspect of the invention.
Figure 8B:
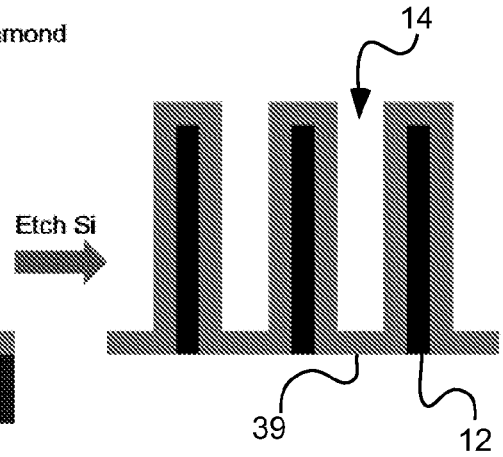

FIGS. 8A and 8B illustrate a very simple exemplary process that can be utilized to fabricate an x-ray window. In FIG. 8A, a forest of nanotubes is grown from a Si substrate, then coated and/or infiltrated with a $Si_3N_4$ interstitial material via a PECVD process. In FIG. 8B, the Si substrate is etched from the base of the frame, leaving the coated frame having a $Si_3N_4$ window attached thereto (or integrated therewith) and ready for use as an x-ray window.

Figure 9A:
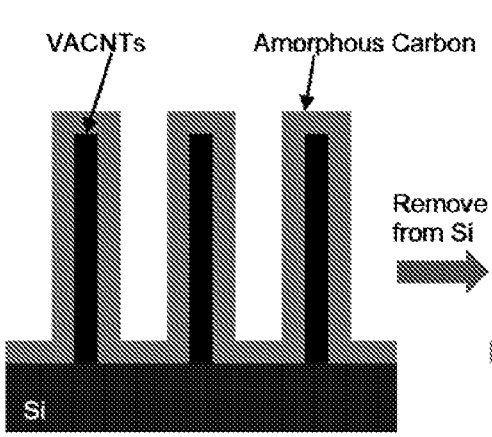
FIGS. 9A through 9D illustrate a series of intervals of a fabrication process used in forming a carbon nanotube x-ray transmissive window in accordance with an aspect of the invention.
Figure 9B:
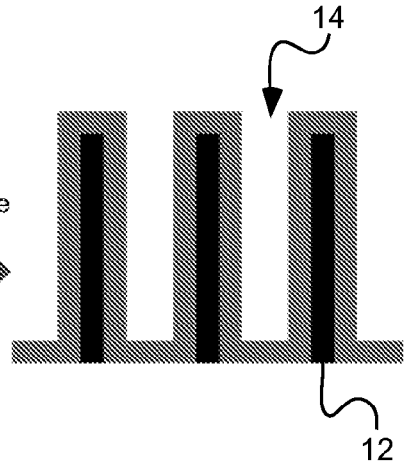
Figure 9C:
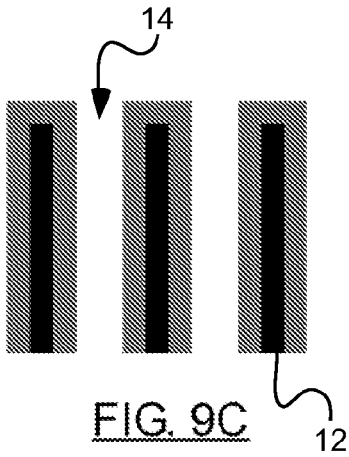
Figure 9D:
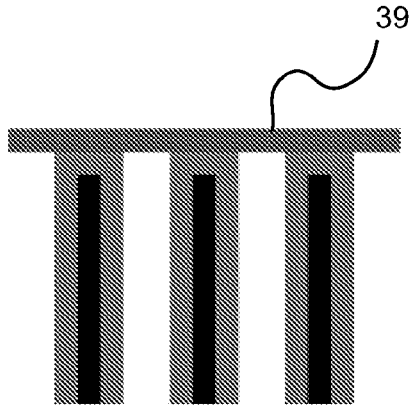

FIGS. 9A through 9D illustrate another exemplary process. In this process, CNT growth from a Si substrate, and amorphous carbon deposition is accomplished as shown in FIG. 9A. In FIG. 9B, the silicon backing or substrate is removed from the frame. In FIG. 9C, $O_2$ plasma removal of the "floor layer" of amorphous carbon clears the passages of unwanted material. At FIG. 9D, a polymer membrane film 39 (e.g., the window material) is attached to the face of the frame, completing the window fabrication.

The film 39 can be formed from a variety of materials in a variety of configurations. In one embodiment, the film can include a layer of polymer material, such as poly-vinyl formar (FORMVAR), butvar, parylene, kevlar, polypropylene or lexan. The film can be suitable to avoid punctures, uneven stretching or localized weakening. The film should be durable enough to withstand pressures to which it will be exposed, such as gravity, normal wear and tear and the like. However, generally speaking, as the thickness of the film increases, so does undesirable absorption of radiation. If radiation is absorbed by the film material, it can affect the accuracy of the sensor or detector. This is particularly true with respect to longer X-rays, which are likely to be absorbed by a thicker film. Therefore, it is desirable to provide a layer of film that is as thin as possible but sufficiently thick to withstand the pressures explained above. In one aspect, the film will be able to withstand at least one atmosphere of pressure, and thus the film can have a thickness less than about 0.30 μm (300 nm).

In addition, a thin coating can be disposed on the film. The thin coating can include boron hydride (BH) and/or aluminum (Al) to prevent transmission of unwanted electromagnetic radiation. In one aspect, the coating can include BH with a thickness of about 20 nm. In another aspect, the coating can be aluminum with a thickness of about 30 nm. The surface of the coating can oxidize spontaneously in air to a depth of about 3 nm. The oxide is transparent to light and so the oxide layers do not contribute to the light blocking capability of the film. The oxide can reduce permeation of nearly all gases and so the layers of BH and/or aluminum oxide increases the resistance of the film to deleterious effects of the environment in which the radiation window is used. The thin coating can also include a gas barrier film layer.

The film can be attached to, or otherwise carried by the frame in a number of manners. In the example shown in FIGS. 8A and 8B, the film is created during infiltration of the CNT forest with the interstitial material. In other examples, the film can be formed independently and bonded to the frame.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by any claims associated with this or related applications.

We claim:

1. An x-ray transmissive window, comprising:

a plurality of carbon nanotubes arranged into a patterned frame;

the plurality of carbon nanotubes being linearly aligned and extending linearly between a base and a face of the patterned frame;

at least one transmission passage defined in the patterned frame, the transmission passage extending from a base of the patterned frame to a face of the patterned frame; and a film carried by the patterned frame, the film at least partially covering the transmission passage while allowing transmission of x-rays through the transmission passage.

2. The window of claim 1, wherein the film is a polymeric film.

3. The window of claim 1, further comprising a gas barrier film layer disposed over the film.

4. The window of claim 1, further comprising an interstitial material, at least partially filling interstices between the carbon nanotubes and binding the nanotubes into a bonded mass.

5. The window of claim 4, wherein the interstitial material is selected from the group consisting of: Beryllium, Boron, Carbon, Magnesium, Aluminum, Diamond, Silicon, Silicon Carbide, Boron Carbide, Boron Nitride, Silicon Nitride and Beryllium Oxide.

6. The window of claim 4, wherein the at least one transmission passage has a diameter or opening size greater than 100 μm; and wherein the nanotubes arranged into the patterned frame define at least one interstitial material access hole extending from the base of the frame to the face of the frame and being substantially devoid of nanotubes and having a diameter or opening size of between 3 to 20 μm.

7. The window of claim 1, wherein the patterned frame includes:

a series of intersecting walls formed by the nanotubes;

the series of walls defining a plurality of passages with each of the passages being substantially devoid of material; and wherein the nanotubes of the walls are oriented substantially parallel to the passages.

8. An x-ray transmissive window, comprising:

a plurality of carbon nanotubes arranged into a patterned frame;

the plurality of carbon nanotubes being linearly aligned and extending linearly between a base and a face of the patterned frame;

an interstitial material at least partially filling interstices between at least some of the carbon nanotubes;

at least one transmission passage defined through the patterned frame;

a film carried by the patterned frame, the film being operable to allow transmission of x-rays through the transmission passage.

9. The window of claim 8, wherein the film is a polymeric film.

10. The window of claim 8, further comprising a gas barrier film layer disposed over the film.

11. The window of claim 8, wherein the interstitial material is selected from the group consisting of: Beryllium, Boron, Carbon, Magnesium, Aluminum, Diamond, Silicon, Silicon Carbide, Boron Carbide, Boron Nitride, Silicon Nitride and Beryllium Oxide.

12. The window of claim 8, wherein the patterned frame includes a series of intersecting walls, the series of walls defining a plurality of passages with each of the passages being substantially devoid of material.

13. The window of claim 8, wherein the at least one transmission passage has a diameter or opening size greater than 100 μm; and wherein the nanotubes arranged into the patterned frame define at least one interstitial material access hole extending from the base of the frame to the face of the frame and being substantially devoid of nanotubes and having a diameter or opening size of between 3 to 20 μm.

14. A radiation detection system, comprising:

an enclosure;

a sensor, contained within the enclosure, the sensor being operable to detect x-rays entering the enclosure;

an x-ray transmissive window attached to the enclosure, the window being formed of: a plurality of carbon nanotubes arranged into a patterned frame, the plurality of carbon nanotubes being linearly aligned and extending linearly between a base and a face of the patterned frame, the patterned frame including at least one transmission passage defined therethrough; and a film carried by the patterned frame, the film at least partially covering the transmission passage while allowing transmission of x-rays through the transmission passage.

15. The system of claim 14, wherein the film is a polymeric film.

16. The system of claim 14, further comprising a gas barrier film layer disposed over the film.

17. The system of claim 14, further comprising an interstitial material, at least partially filling interstices between the carbon nanotubes and binding the nanotubes into a solid mass.

18. The system of claim 17, wherein the interstitial material is selected from the group consisting of: Beryllium, Boron, Carbon, Magnesium, Aluminum, Diamond, Silicon, Silicon Carbide, Boron Carbide, Boron Nitride, Silicon Nitride and Beryllium Oxide.

19. The system of claim 17, wherein the patterned frame includes:

a series of intersecting walls formed by the nanotubes;

the series of walls defining a plurality of passages with each of the passages being substantially devoid of material; and wherein the nanotubes of the walls extend substantially parallel to the passages.

20. The system of claim 14, wherein the nanotubes arranged into the patterned frame define at least one interstitial material access hole extending from a base of the frame to a face of the frame and being substantially devoid of nanotubes and at least partially filled with interstitial material.

* * * * *